US011543150B2

(12) United States Patent
Chuang et al.

(10) Patent No.: US 11,543,150 B2
(45) Date of Patent: Jan. 3, 2023

(54) FIXING STRUCTURE AND VENTILATION FAN THEREFOR

(71) Applicant: Delta Electronics, Inc., Taoyuan (TW)

(72) Inventors: Ying-Huang Chuang, Taoyuan (TW); Chun-Wei Chen, Taoyuan (TW); Wen-Hsiang Lin, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 185 days.

(21) Appl. No.: 16/781,921

(22) Filed: Feb. 4, 2020

(65) Prior Publication Data

US 2020/0393162 A1 Dec. 17, 2020

(30) Foreign Application Priority Data

Jun. 14, 2019 (CN) ..... 201910514440.1

(51) Int. Cl.

| | |
|---|---|
| ***F24F 13/20*** | (2006.01) |
| ***F24F 7/007*** | (2006.01) |
| ***F24F 13/06*** | (2006.01) |

(52) U.S. Cl.

CPC ..... *F24F 13/20* (2013.01); *F24F 7/007* (2013.01); *F24F 2013/205* (2013.01)

(58) Field of Classification Search

CPC .. F24F 7/007; F24F 13/06; F24F 13/32; F24F 2013/205; F04D 29/601; F04D 29/60; F04D 25/12

See application file for complete search history.

(56) References Cited

U.S. PATENT DOCUMENTS

2008/0299891 A1* 12/2008 Deng ..... F21V 19/04 454/354

FOREIGN PATENT DOCUMENTS

| | | | |
|---|---|---|---|
| CN | 2282546 | Y * | 5/1998 |
| CN | 2282546 | Y | 5/1998 |
| CN | 2295948 | Y | 10/1998 |
| CN | 1643235 | A | 7/2005 |
| CN | 2894204 | Y | 4/2007 |
| CN | 101063457 | A | 10/2007 |
| CN | 201028423 | Y | 2/2008 |
| CN | 101210579 | A | 7/2008 |

(Continued)

OTHER PUBLICATIONS

Mukesh Saraswat, "Fillet and Chamfer Why and When to use it", Aug. 3, 2018 (Year: 2018).*

*Primary Examiner* — Steven S Anderson, II

(74) *Attorney, Agent, or Firm* — Kirton McConkie; Evan R. Witt

(57) ABSTRACT

The present disclosure provides a fixing structure including a base, a first fastener, and a second fastener. The first fastener is disposed on the base and comprises a first hook portion, a first accommodation portion and a first opening portion. The second fastener is disposed on the base and comprises a second hook portion, a second accommodation portion and a second opening portion. A guiding groove is defined by and located between the first and second fasteners and is in communication with the first and second accommodation portions. A positioning channel is defined by the guiding groove, and the first and second accommodation portions, collaboratively. The first and second opening portions are located on the opposite sides of the positioning channel, respectively.

15 Claims, 10 Drawing Sheets

(56) References Cited

FOREIGN PATENT DOCUMENTS

| | | | | |
|---|---|---|---|---|
| CN | 101440824 | A | | 5/2009 |
| CN | 101440825 | A | | 5/2009 |
| CN | 203770232 | | * | 8/2014 |
| CN | 203770232 | U | | 8/2014 |
| CN | 105317710 | A | | 2/2016 |
| CN | 106931579 | A | | 7/2017 |
| CN | 208185072 | U | | 12/2018 |
| JP | 2000055434 | A | | 2/2000 |
| JP | 5602090 | B2 | | 10/2014 |
| TW | 201614175 | A | | 4/2016 |
| TW | I547645 | B | | 9/2016 |
| TW | I609160 | B | | 12/2017 |

* cited by examiner

FIXING STRUCTURE AND VENTILATION FAN THEREFOR

FIELD OF THE INVENTION

The present disclosure relates to a fixing structure and ventilation fan therefor, and more particularly to a fixing structure and ventilation fan therefor that the elastic element thereof can be manually rotated for fixation.

BACKGROUND OF THE INVENTION

In order to improve indoor air convection, many buildings are equipped with ventilation fans to keep the air fresh. Generally, an outer cover is disposed on the fan body of the ventilation fan after fan body is mounted. The outer cover is not only provided for air entrance and blocking external objects, but also can be used for mounting luminaires or decorations thereon. Since there is a need of regular cleaning, maintenance and replacement for the outer cover or the fan body, the outer cover should be removed and mounted quickly and repeatedly. Currently, springs are utilized and disposed on the outer cover to allow the outer cover to be mounted quickly through the elasticity and be used as buffer for adapting the assembling gaps due to different thicknesses of ceilings. Therefore, springs are indispensable for the outer cover of the ventilation fans, and relatedly, the fixing structure for fixing the springs also plays an important role.

The conventional ways of fixing the springs include screw fixing method and fitting fastening method. In the screw fixing method, the springs are fixed on the outer cover by screws and metal fittings, which has drawbacks of the complicated assembly process and high material cost. In the fitting fastening method, the spring is placed on a corresponding position of a metal elastic piece or plastic fitting, which is subsequently fixed with a fastener on the outer cover. Although the assembly process of the fitting fastening method is more simplified than the screw fixing method, it still needs extra components to complete the assembling. In addition, the intensity of the metal elastic piece or plastic fitting is not good enough and may be deformed by the pulling action when removing the outer cover, and thus causing the risk of the outer cover falling.

Therefore, for overcoming the drawbacks of the conventional methods of fixing the springs, the present disclosure provides a novel fixing structure and ventilation fan therefor which can achieve the efficacies of simplifying manufacturing process and assembling process, saving material cost and time cost, and providing sufficient stability and adaptability.

SUMMARY OF THE INVENTION

It is an object of the present disclosure to provide a fixing structure and ventilation fan therefor that the elastic element thereof can be manually rotated for fixation. The elastic element can be quickly fixed with the fixing structure and will not be detached easily due to the force generated during the operation of the ventilation fan. Consequently, the manufacture process is simplified, the costs of material and time are saved, and the stability of the fixing structure is improved.

It is another object of the present disclosure to provide a fixing structure and ventilation fan therefor that the elastic element thereof can be manually rotated for fixation. By the elastically deformable structure, the fixing structure is adapted to the elastic elements with different sizes.

In accordance with an aspect of the present disclosure, there is provided a fixing structure. The fixing structure includes a base, a first fastener, and a second fastener. The first fastener is disposed on the base and includes a first hook portion, a first accommodation portion and a first opening portion. The second fastener is disposed on the base and includes a second hook portion, a second accommodation portion and a second opening portion. A guiding groove is defined by and located between the first and second fasteners and is in communication with the first and second accommodation portions. A positioning channel is defined by the guiding groove, and the first and second accommodation portions, collaboratively. The first and second opening portions are located on the opposite sides of the positioning channel, respectively.

In accordance with another aspect of the present disclosure, there is provided a ventilation fan mounted on a ceiling. The ceiling includes a mounting vent, a first side and a second side. The ventilation fan includes a case, a fan assembly, and an outer cover. The case is disposed on the first side of the ceiling and includes a first vent. The first vent is adjacent to the mounting vent of the ceiling. The fan assembly is accommodated in the case. The outer cover is disposed on the second side of the ceiling and includes at least one fixing structure and at least one elastic element. The fixing structure includes a base, a first fastener, and a second fastener. The first fastener is disposed on the base and includes a first hook portion, a first accommodation portion and a first opening portion. The second fastener is disposed on the base and includes a second hook portion, a second accommodation portion and a second opening portion. A guiding groove is defined by and located between the first and second fasteners and is in communication with the first and second accommodation portions. A positioning channel is defined by the guiding groove, and the first and second accommodation portions, collaboratively. The first and second opening portions are located on the opposite sides of the positioning channel, respectively. The elastic element is fixed with the fixing structure and is extended through the first vent of the case to be connected to the case.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
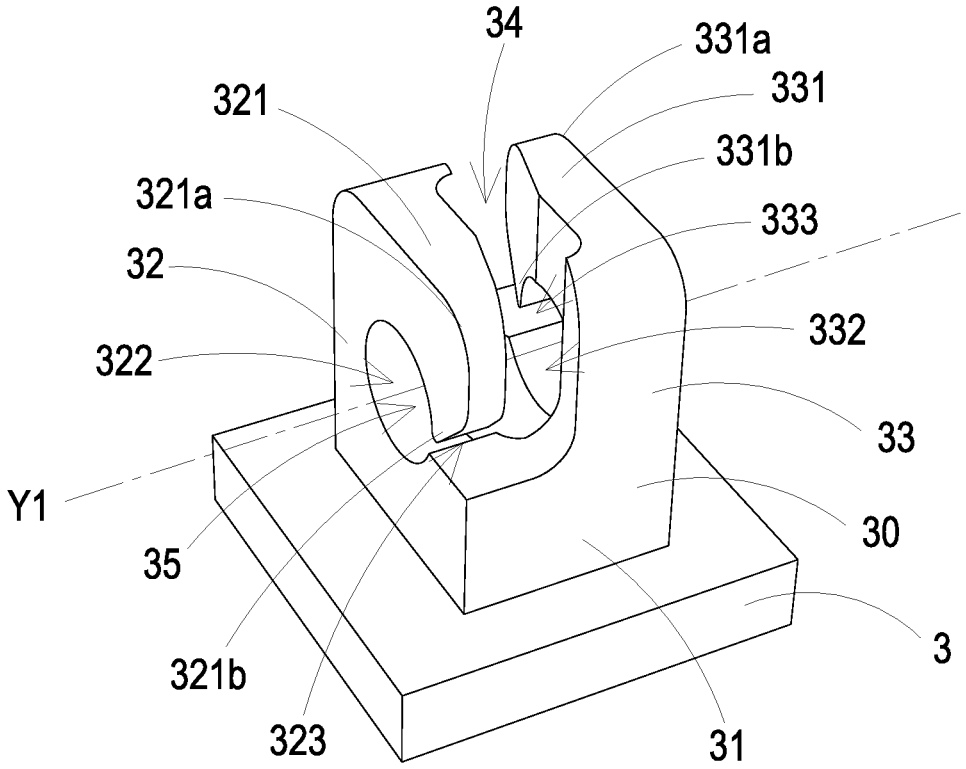
FIG. 1 is a schematic perspective view illustrating the fixing structure according to a first embodiment of the present disclosure.
Figure 2A:
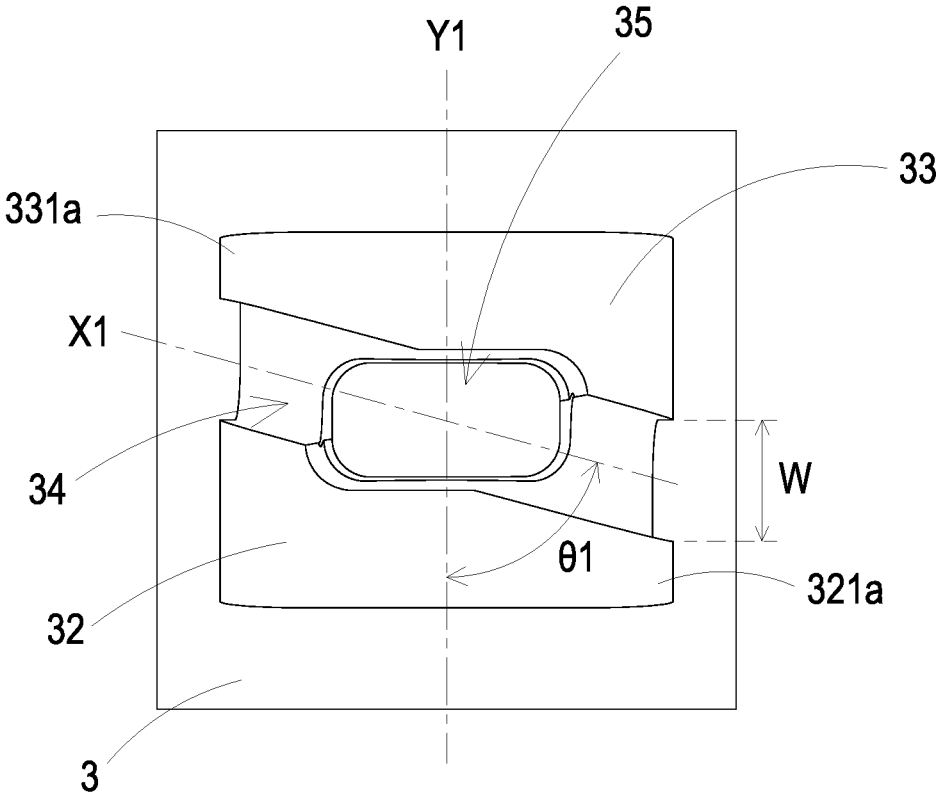
FIG. 2A is a top view illustrating the fixing structure of FIG. 1.
Figure 2B:
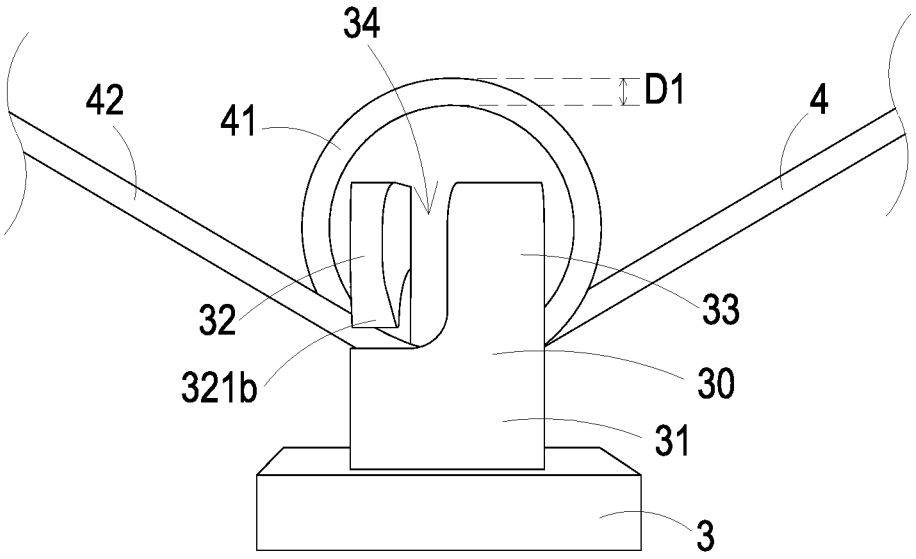
FIG. 2B is a front view illustrating the fixing structure of FIG. 1 and the elastic element accommodated in the fixing structure.
Figure 2C:
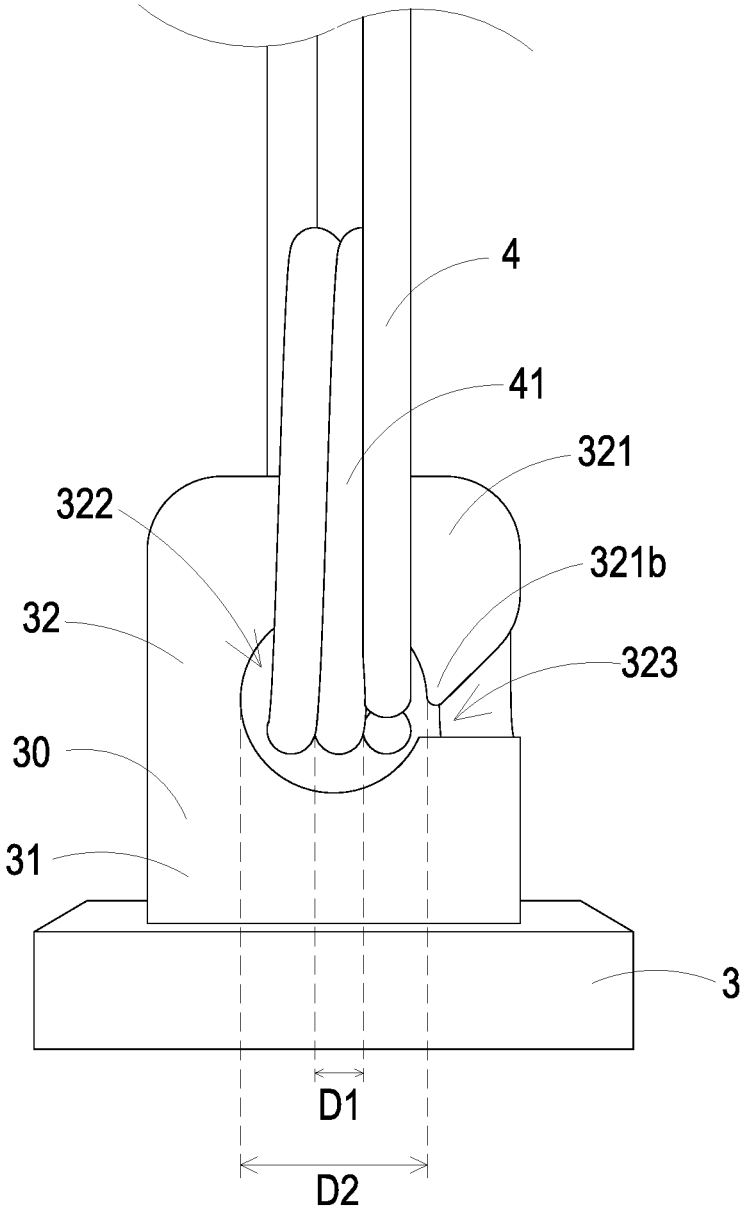
FIG. 2C is a side view illustrating the fixing structure of FIG. 1 and the elastic element accommodated in the fixing structure.

Please refer to FIGS. 1, 2A, 2B and 2C. FIG. 1 is a schematic perspective view illustrating the fixing structure according to a first embodiment of the present disclosure. FIG. 2A is a top view illustrating the fixing structure of FIG. 1. FIG. 2B is a front view illustrating the fixing structure of FIG. 1 and the elastic element accommodated in the fixing structure. FIG. 2C is a side view illustrating the fixing structure of FIG. 1 and the elastic element accommodated in the fixing structure. The fixing structure 30 is configured to fix the elastic element 4 and includes a base 31, a first fastener 32, and a second fastener 33. The first fastener 32 is disposed on the base 31 and includes a first hook portion 321, a first accommodation portion 322 and a first opening portion 323. The first accommodation portion 322 is defined by and located between the inside of the first hook portion 321 and the base 31. The first opening portion 323 is defined by and located between the end of the first hook portion 321 and the base 31. The second fastener 33 is disposed on the base 31 and includes a second hook portion 331, a second accommodation portion 332 and a second opening portion 333. The second accommodation portion 332 is defined by and located between the inside of the second hook portion 331 and the base 31. The second opening portion 333 is defined by and located between the end of the second hook portion 331 and the base 31. A guiding groove 34 is defined by and located between the first and second fasteners 32, 33 and is in communication with the first accommodation portion 322 of the first fastener 32 and the second accommodation portion 332 of the second fastener 33. A positioning channel 35 is defined by the guiding groove 34, and the first and second accommodation portions 322, 332, collaboratively. The first opening portion 323 of the first fastener 32 and the second opening portion 333 of the second fastener 33 are located on the opposite sides of the positioning channel 35, respectively. In other words, the first and second fasteners 32, 33 are formed as two oppositely disposed structures, that is, the first and second hook portions 321, 331 are extended toward opposite directions. In this embodiment, the fixing structure 30 is disposed on an outer cover 3. The following descriptions are focused on the structural features of the fixing structure 30, and thus, FIGS. 1 to 2C only symbolically show the partial structure of the outer cover 3 instead of showing the whole structure thereof.

In this embodiment, the elastic element 4 fixed by the fixing structure 30 is a V-shaped spring and is made of a metal wire, but not limited thereto. The elastic element 4 has a wire diameter D1 and includes a winding body 41 and two extending portions 42. The two extending portions 42 are connected to the opposite sides of the winding body 41, respectively. In this embodiment, the wire diameter D1 is adjustable according to the practical requirements. For example, the wire diameter D1 can be in the range between 1.0 mm and 2.0 mm, but not limited thereto. The winding body 41 can be spiral winding coil, which has plural tightly-stacked winding layers. During the process of fixing the elastic element 4 on the fixing structure 30, the winding body 41 of the elastic element 4 is first accommodated in the guiding groove 34 in the direction indicated by the axis X1, and then is rotated by an angle θ1. Thereby, the winding body 41 passes through the first and second opening portions 323, 333 and is partially accommodated in the positioning channel 35 in the direction indicated by the axis Y1. Consequently, the elastic element 4 is connected to the outer cover 3 through the fixing structure 30. Generally, the angle θ1 is in the range between 0 degrees and 90 degrees.

In this embodiment, the guiding groove 34 of the fixing structure 30 has a groove width W. The groove width W of the guiding groove 34 is adjustable according to a number of winding layers of the winding body 41. For example, the groove width W is greater than or equal to the multiple of the wire diameter D1 of the elastic element 4.

In this embodiment, the first hook portion 321 of the fixing structure 30 includes a turning portion 321*a* and an end portion 321*b*. The second hook portion 331 of the fixing structure 30 includes a turning portion 331*a* and an end portion 331*b*. The space between the end portion 321*b* of the first hook portion 321 and the base 31 is defined as the first opening portion 323. The space between the end portion 331*b* of the second hook portion 331 and the base 31 is defined as the second opening portion 333. In this embodiment, the end portion 321*b* of the first hook portion 321 and the end portion 331*b* of the second hook portion 331 are subjected to chamfering. Consequently, the opening sizes of the first and second opening portions 323, 333 are gradually shrunk from the outside to the inside so that the winding body 41 of the elastic element 4 can pass the first and second opening portions 323, 333 more easily. It should be noticed that the shortest distance between the end portion 321*b* of the first hook portion 321 and the base 31 and the shortest distance between the end portion 331*b* of the second hook portion 331 and the base 31 are slightly smaller than the wire diameter D1 of the elastic element 4, respectively. In this embodiment, the fixing structure 30 is made of plastic. Therefore, the first and second hook portions 321, 331 can be deformed when the winding body 41 passes through the first and second opening portions 323, 333, thereby allowing the winding body 41 to enter the first and second accommodation portions 322, 332. Further, each of the first and second accommodation portions 322, 332 has an inner diameter D2. The inner diameter D2 is adjustable according to the number of winding layers of the winding body 41 of the elastic element 4. For example, the inner diameter D2 is greater than two times or three times of the wire diameter D1 of the elastic element 4 as the number of winding layers of the winding body 41 is two or three, so that the winding body 41 can be accommodated in the first and second accommodation portions 322, 332. When the winding body 41 is accommodated in the positioning channel 35 defined by the guiding groove 34 and the first and second accommodation portions 322, 332, since the shortest distance between the first hook portion 321 and the base 31 and the shortest distance between the second hook portion 331 and the base 31 are smaller than the wire diameter D1 of the elastic element 4, respectively, the winding body 41 can be prevented from being easily detached from the fixing structure 30 through the first and second opening portions 323, 333 by a reverse rotation.

Figure 3:
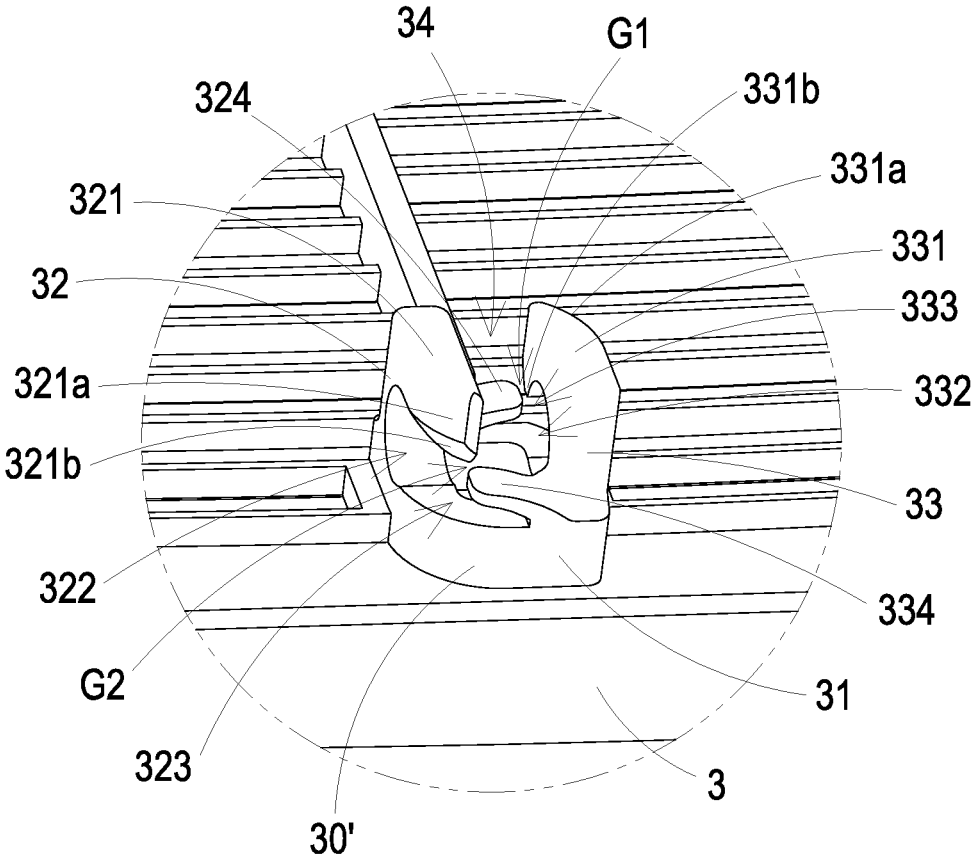
FIG. 3 is a schematic perspective view illustrating the fixing structure according to a second embodiment of the present disclosure.
Figure 4A:
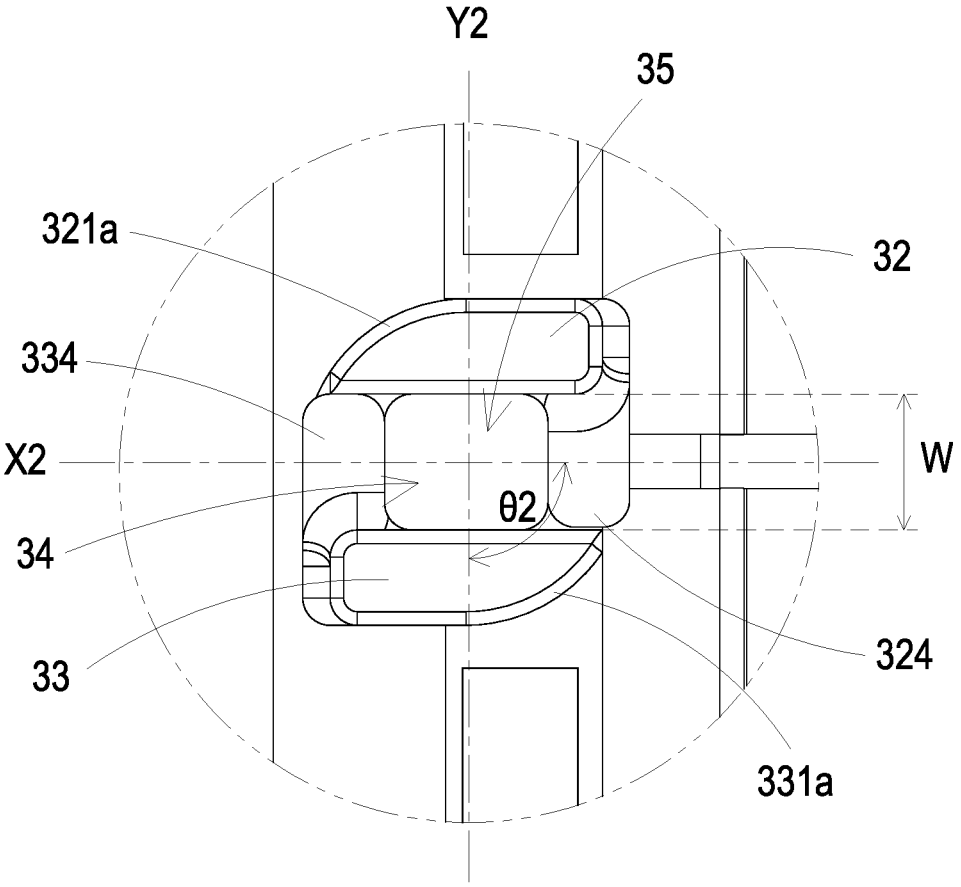
FIG. 4A is a top view illustrating the fixing structure of FIG. 3.
Figure 4B:
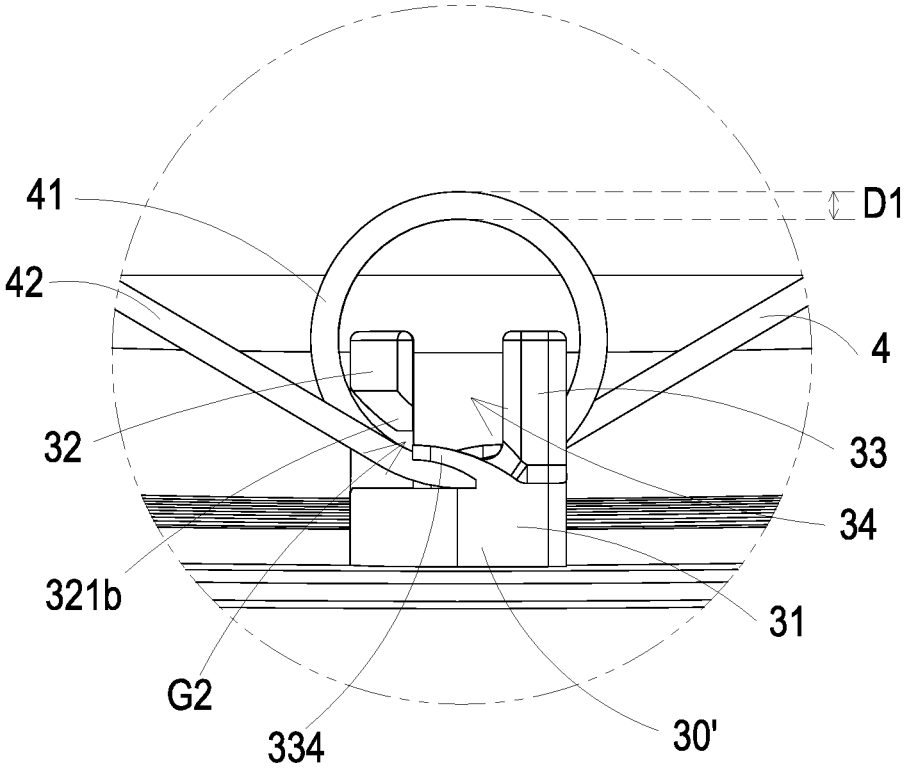
FIG. 4B is a front view illustrating the fixing structure of FIG. 3 and the elastic element accommodated in the fixing structure.
Figure 4C:
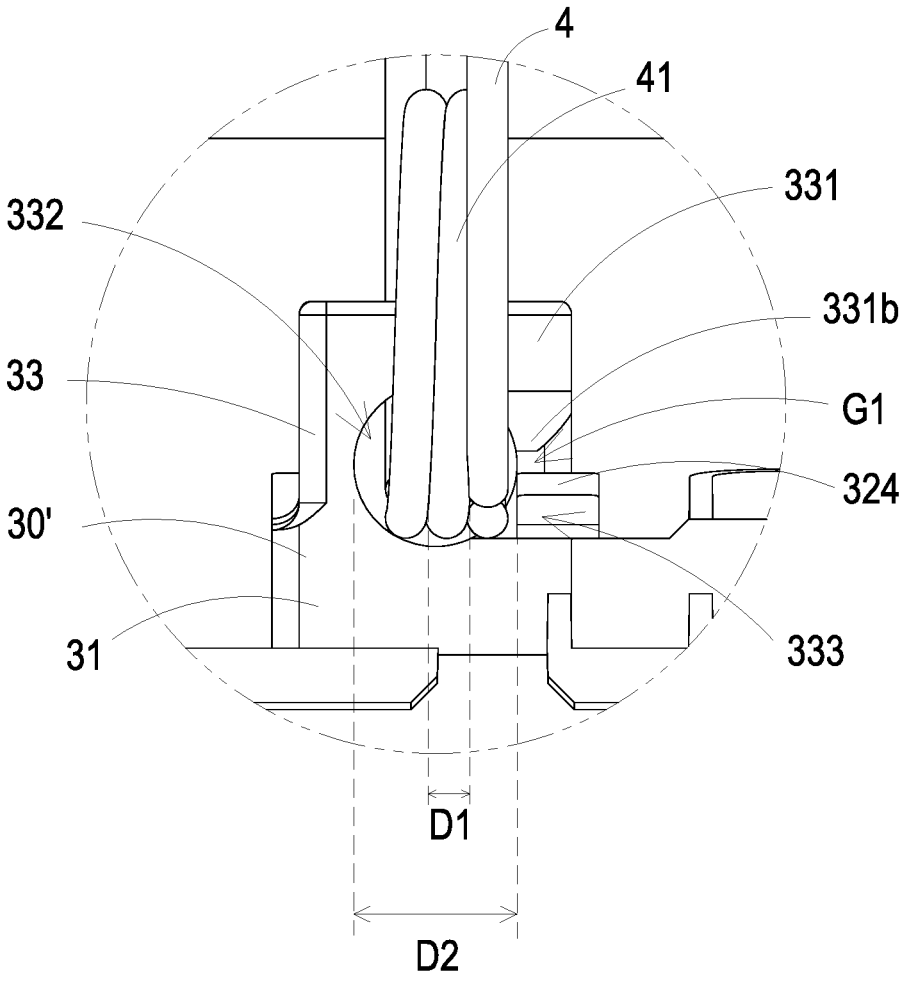
FIG. 4C is a side view illustrating the fixing structure of FIG. 3 and the elastic element accommodated in the fixing structure.

Please refer to FIGS. 3, 4A, 4B and 4C. FIG. 3 is a schematic perspective view illustrating the fixing structure according to a second embodiment of the present disclosure. FIG. 4A is a top view illustrating the fixing structure of FIG. 3. FIG. 4B is a front view illustrating the fixing structure of FIG. 3 and the elastic element accommodated in the fixing structure. FIG. 4C is a side view illustrating the fixing structure of FIG. 3 and the elastic element accommodated in the fixing structure. In this embodiment, the fixing structure 30' is disposed on the outer cover 3. Compared to the first embodiment of the present disclosure, the first fastener 32 further includes a first tongue portion 324, and the second fastener 33 further includes a second tongue portion 334. The first tongue portion 324 is extended from the root of the first fastener 32 toward the second opening portion 333 of the second fastener 33, and a gap G1 is defined by and located between the first tongue portion 324 and the end portion 331*b* of the second hook portion 331 of the second fastener 33. The second tongue portion 334 is extended from the root of the second fastener 33 toward the first opening portion 323 of the first fastener 32, and a gap G2 is defined by and located between the second tongue portion 334 and the end portion 321*b* of the first hook portion 321 of the first fastener 32. The first tongue portion 324 and the second tongue portion 334 can be elastically deformed when the winding body 41 passes through the gaps G1 and G2. In this embodiment, the profiles of the first tongue portion 324 and the second tongue portion 334 are flakes, substantially. The first tongue portion 324 and the second tongue portion 334 are kept a distance from the base 31, so as to provide a buffer space for deformation, but not limited thereto.

In this embodiment, during the process of fixing the elastic element 4 on the fixing structure 30', the winding body 41 of the elastic element 4 is first accommodated in the guiding groove 34 in the direction indicated by the axis X2, and then is rotated by an angle θ2. Thereby, the winding body 41 passes through the gaps G1 and G2 and is partially accommodated in the positioning channel 35 in the direction indicated by the axis Y2. Consequently, the elastic element 4 is connected to the outer cover 3 through the fixing structure 30', and the elastic element 4 is restricted in the positioning channel 35. The angle θ2 is in the range between 0 degrees and 90 degrees. In this embodiment, the groove width W is greater than or equal to the product of the wire diameter D1 of the elastic element 4 and the number of winding layers of the winding body 41. For example, the groove width W is greater than or equal to two times or three times of the wire diameter D1 of the elastic element 4 as the number of winding layers of the winding body 41 is two or three.

In this embodiment, the turning portion 321*a* of the first hook portion 321 and the turning portion 331*a* of the second hook portion 331 have a curved-surface structure, selectively. The curved-surface structure is designed according to the rotating route of the elastic element 4. As a result, straight-line distances between the turning portion 321*a* of the first hook portion 321 and the turning portion 331*a* of the second hook portion 331 are shortened, and thus, the structural interference is reduced. Consequently, the winding body 41 can bypass the first hook portion 321 and the second hook portion 331 more easily when being rotated. In this embodiment, the end portion 321*b* of the first hook portion 321 and the end portion 331*b* of the second hook portion 331 can also have the curved-surface structure, selectively. Similarly, the curved-surface structure is designed according to the rotating route of the elastic element 4 so that the winding body 41 can pass the gaps G1 and G2 more smoothly. It should be noticed that the curved-surface structures of the turning portions 321*a* and 331*a* and the end portions 321*b* and 331*b* described above can also be utilized in the first embodiment of the present disclosure.

In this embodiment, the gap G1 defined by the first tongue portion 324 and the end portion 331*b* of the second hook portion 331 is smaller than the wire diameter D1 of the elastic element 4, and the gap G2 defined by the second tongue portion 334 and the end portion 321*b* of the first hook portion 321 is smaller than the wire diameter D1 of the elastic element 4, but not limited thereto. By the elastic deformation of the first tongue portion 324 and the second tongue portion 334, the winding body 41 can pass the gaps G1 and G2 and enter the second accommodation portion 332 and the first accommodation portion 322. Each of the first accommodation portion 322 and the second accommodation portion 332 has the inner diameter D2, respectively. The inner diameter D2 is adjustable according to the number of winding layers of the winding body 41 of the elastic element 4. For example, the inner diameter D2 is greater than or equal to two times or three times of the wire diameter D1 of the elastic element 4, so that the winding body 41 can be accommodated in the first accommodation portion 322 and the second accommodation portion 332 as the number of winding layers of the winding body 41 is two or three. When the winding body 41 is accommodated in the positioning channel 35 defined by the guiding groove 34, the first accommodation portion 322 and the second accommodation portion 332, the first tongue portion 324 and the second tongue portion 334 block on the first opening portion 323 and the second opening portion 333. Consequently, the winding body 41 can be prevented from being easily detached from the fixing structure 30' by a reverse rotation.

Figure 5:
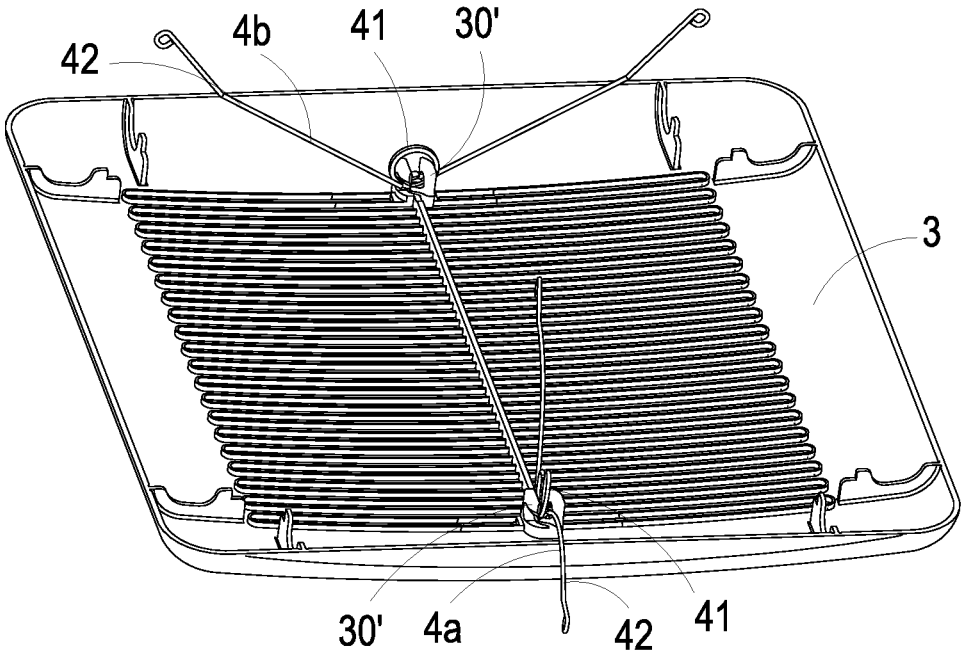
FIG. 5 is a schematic perspective view illustrating the fixing structure of FIG. 3, the elastic element and the outer cover of the ventilation fan.

Please refer to FIGS. 3, 4A, 4B, 4C and 5. FIG. 5 is a schematic perspective view illustrating the fixing structure of FIG. 3, the elastic element and the outer cover of the ventilation fan. In this embodiment, specifically but not exclusively, the outer cover 3 includes two fixing structures 30'. The fixing structures 30' and the outer cover 3 are integrally formed with each other and are made of plastic, but not limited thereto. For ease of description, the elastic element 4*a* and the elastic element 4*b* shown in FIG. 5 represent the elastic elements 4 which are in a pre-positioning state and in a fixing state, respectively. First, the winding body 41 of the elastic element 4*a* is accommodated in the guiding groove 34 for pre-positioning and then is rotated in clockwise direction. By the elastic deformation of the first and second tongue portions 324, 334, the winding body 41 can pass through the gaps G1 and G2 and enter the first and second accommodation portions 322, 332. At this time, as shown as the elastic element 4*b*, the winding body 41 is partially accommodated in the positioning channel 35 defined by the guiding groove 34, the first and second accommodation portions 322, 332, and the fixing of the elastic element 4 is completed. It should be noticed that the rotation direction of the elastic element 4 is not limited to clockwise direction, and it is adjustable according to the variety of the structure of the fixing structure 30'.

In this embodiment, after the fixing of the elastic element 4 is completed, owing to the arrangement of the first and second tongue portions 324, 334 described above, the winding body 41 will be blocked by the first and second tongue portions 324, 334 when the winding body 41 is reversely rotated. Therefore, the winding body 41 is restricted in the positioning channel 35, and the efficacy of preventing the elastic element 4 from being detached is achieved. Furthermore, by the elastic deformation of the first and second tongue portions 324, 334, the fixing structure 30' is adapted to elastic elements 4 with different wire diameters D1. When the weight of the outer cover 3 is increased due to the luminaires, decorations or other functional components mounted thereon, and there is a need of increasing the wire diameter D1 to enhance the elastic force to support it, the fixing structure 30' can be adapted to the elastic element 4 with larger wire diameter D1 by the elastic deformation of the first and second tongue portions 324, 334. Consequently, there is no need to redesign the structure and revise the mold of the fixing structure 30' when the wire diameter D1 of the elastic element 4 is increased. As a result, the costs of design and manufacture are reduced. By the features of the fixing structure 30' described above, the efficacies of simplifying the manufacture process and saving the material cost and assembling time are achieved. Furthermore, the stability of the connection between the elastic element 4 and the outer cover 3 is maintained, and the fixing structure 30' is provided with excellent adaptability.

Figure 6:
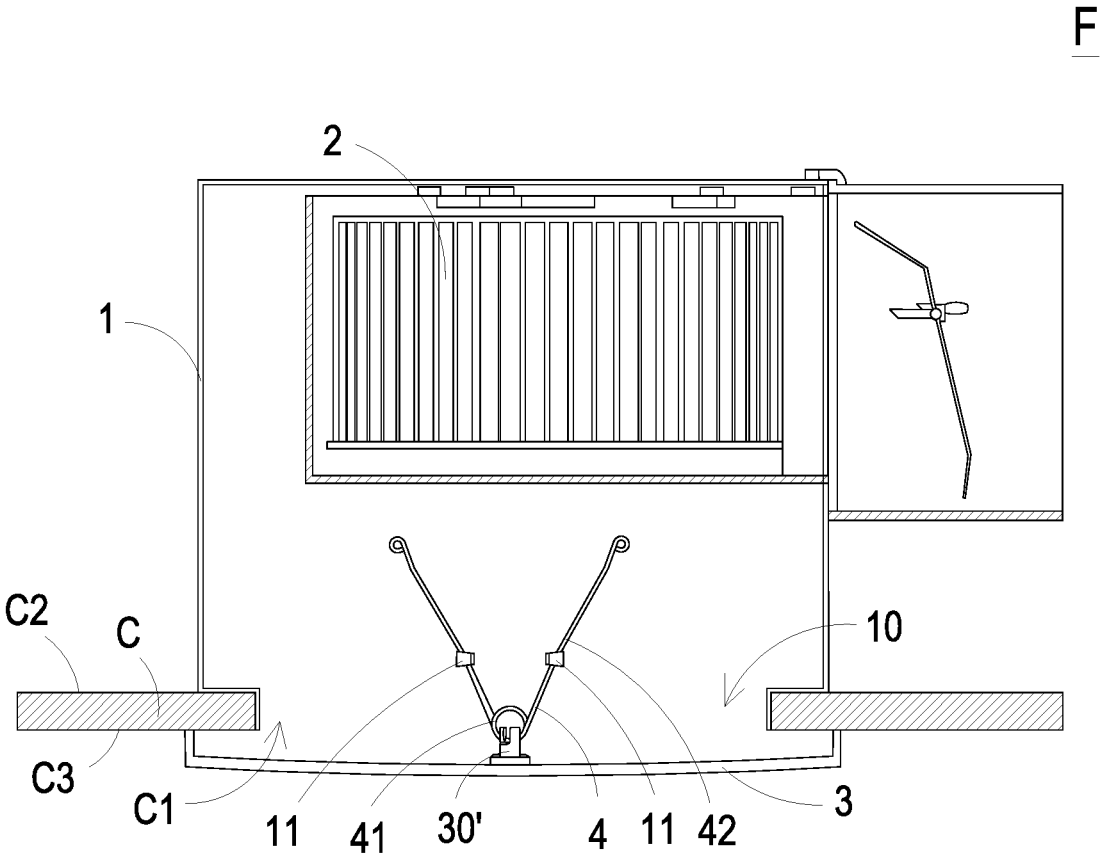
FIG. 6 is a cross sectional view illustrating the ventilation fan according to an embodiment of the present disclosure.

Please refer to FIGS. 5 and 6. FIG. 6 is a cross sectional view illustrating the ventilation fan according to an embodiment of the present disclosure. In this embodiment, the ventilation fan F is mounted on the ceiling C. The ceiling C includes a mounting vent C1, a first side C2 and a second side C3. The ventilation fan F includes a case 1, a fan assembly 2 and the outer cover 3. The case 1 is disposed on the first side C2 of the ceiling C and includes a first vent 10. The first vent 10 is adjacent to the mounting vent C1 of the ceiling C. The fan assembly 2 is accommodated in the case 1. The outer cover 3 is disposed on the second side C3 of the ceiling C and includes at least one fixing structure 30' and at least one elastic element 4 described above. The elastic element 4 is fixed with the fixing structure 30', and the extending portions 42 of the elastic element 4 are extended through the first vent 10 of the case 1 and are connected to at least one fixing element 11 of the case 1. During the operation of the ventilation fan F, the weight of the outer cover 3 may cause the fixing structure 30' be deformed due to the pulling force. However, since the first and second fasteners 32, 33 of the present disclosure are oppositely disposed structures, the directions of the openings are different from the direction of the pulling force. In addition, the direction of the pulling force will not cause the elastic element 4 to rotate. Therefore, even if the first and second opening portions 323, 333 are expanded by the pulling force, the elastic element 4 will not be easily separated from the positioning channel 35 through the first and second opening portions 323, 333. Furthermore, even if one of the first and second fasteners 32, 33 is destroyed, there is still one fastener can keep the connection between the elastic element 4 and the outer cover 3. Thereby, a first detachment-prevention mechanism is realized. Additionally, by the arrangements of the first and second hook portions 321, 331, and the first and second tongue portions 324, 334, it is difficult for the elastic element 4 to leave from the positioning channel 35, and thus, a second detachment-prevention mechanism is realized. Consequently, owing to the double detachment-prevention mechanisms described above, the fixing structure 30' of the present disclosure can effectively prevent the elastic element 4 from being detached, and the stability of the connection between the case 1 and the outer cover 3 of the ventilation fan F can also be maintained.

From the above descriptions, the present disclosure provides a fixing structure and ventilation fan therefor. The first fastener and the second fastener of the fixing structure are formed as two oppositely disposed structures. By fixing the elastic element by the oppositely disposed structures, the manufacture processes of the outer cover and the fixing structure are simplified. Since it is no longer necessary to fix the elastic element by the extra component, the costs of material and time are both saved. In addition, the detachment of the elastic element is prevented effectively, and the stability of the connection between the outer cover and the case is maintained. Furthermore, by the elastic deformation of the first hook portion, the first tongue portion, the second hook portion and the second tongue portion, the fixing structure is adapted to elastic elements with different wire diameters, and thus, sufficient supporting force can be provided when the luminaires, decorations or other functional components are mounted on the outer cover. Consequently, the fixing structure and ventilation fan therefor of the present disclosure can not only reduce the costs of material and time, maintain the stability of the connection between the outer cover and the case, but also have excellent adaptability.

While the disclosure has been described in terms of what is presently considered to be the most practical and preferred embodiments, it is to be understood that the disclosure needs not be limited to the disclosed embodiment.

What is claimed is:

1. A fixing structure, comprising:

a base;

a first fastener disposed on the base and comprising a first hook portion, a first accommodation portion and a first opening portion; and a second fastener disposed on the base and comprising a second hook portion, a second accommodation portion and a second opening portion;

wherein the first fastener and the second fastener are formed as two oppositely disposed structures, and the first accommodation portion is disposed corresponding to the second accommodation portion, a guiding groove is defined by and located between the first fastener and the second fastener and is in communication with the first fastener and the second fastener, and a positioning channel is defined by the guiding groove, the first accommodation portion and the second accommodation portion in a Y axis, collaboratively, wherein the first opening portion and the second opening portion are located on the opposite sides of the positioning channel, respectively, wherein a winding body of an elastic element is accommodated in the guiding groove and is rotated by an angle, thereby passing through the first opening portion and the second opening portion and being partially accommodated in the positioning channel, so that the winding body of the elastic element is in a fixing position, which is partially disposing within the guiding groove, the first accommodation portion and the second accommodation portion of the fixing structure, and wherein the first fastener further comprises a first tongue portion, the first tongue portion is extended from the first fastener toward the second opening portion of the second fastener, and a gap is defined by and located between the first tongue portion and an end portion of the second hook portion of the second fastener.

2. The fixing structure according to claim 1, wherein the angle is greater than 0 degrees.

3. The fixing structure according to claim 1, wherein the gap is smaller than a wire diameter of the elastic element, and the first tongue portion is deformable.

4. The fixing structure according to claim 1, wherein the second fastener further comprises a second tongue portion, the second tongue portion is extended from the second fastener toward the first opening portion of the first fastener, and a gap is defined by and located between the second tongue portion and an end portion of the first hook portion of the first fastener.

5. The fixing structure according to claim 4, wherein the gap is smaller than a wire diameter of the elastic element, and the second tongue portion is deformable.

6. The fixing structure according to claim 1, wherein the first hook portion and the second hook portion are subjected to chamfering, and the shortest distance between the first hook portion and the base and the shortest distance between the second hook portion and the base are smaller than a wire diameter of the elastic element.

7. The fixing structure according to claim 1, wherein each of the first hook portion and the second hook portion comprises a turning portion and an end portion, and at least one of the turning portion and the end portion has a curved-surface structure.

8. The fixing structure according to claim 1, wherein each of the first accommodation portion and the second accommodation portion has an inner diameter, and the inner diameter is greater than two times of a wire diameter of the elastic element.

9. The fixing structure according to claim 1, wherein a wire diameter of the elastic element is in the range between 1.0 mm and 2.0 mm.

10. A ventilation fan mounted on a ceiling, the ceiling comprising a mounting vent, a first side and a second side, the ventilation fan comprising:

a case disposed on the first side of the ceiling and comprising a first vent, wherein the first vent is adjacent to the mounting vent of the ceiling;

a fan assembly accommodated in the case; and an outer cover disposed on the second side of the ceiling and comprising:

at least one fixing structure comprising:

a base;

a first fastener disposed on the base and comprising a first hook portion, a first accommodation portion and a first opening portion; and a second fastener disposed on the base and comprising a second hook portion, a second accommodation portion and a second opening portion;

wherein the first fastener and the second fastener are formed as two oppositely disposed structures, and the first accommodation portion is disposed corresponding to the second accommodation portion, a guiding groove is defined between the first fastener and the second fastener and is in communication with the first fastener and the second fastener, and a positioning channel is defined by the guiding groove, the first accommodation portion and the second accommodation portion in a Y axis, collaboratively, wherein the first opening portion and the second opening portion are located on the opposite sides of the positioning channel, respectively; and at least one elastic element being fixed with the at least one fixing structure and extended through the first vent of the case to be connected to the case;

wherein a winding body of the at least one elastic element is accommodated in the guiding groove and is rotated by an angle, thereby passing through the first opening portion and the second opening portion and being partially accommodated in the positioning channel, so that the winding body of the at least one elastic element is in a fixing position, which is partially disposing within the guiding groove, the first accommodation portion and the second accommodation portion of the at least one fixing structure, and wherein the first fastener further comprises a first tongue portion, the first tongue portion is extended from the first fastener toward the second opening portion of the second fastener, a gap is defined by and located between the first tongue portion and an end portion of the second hook portion of the second fastener, the gap is smaller than a wire diameter of the at least one elastic element, and the first tongue portion is deformable.

11. The ventilation fan according to claim 10, wherein the at least one fixing structure and the outer cover are integrally formed with each other.

12. The ventilation fan according to claim 10, wherein the at least one elastic element comprises two extending portions, the two extending portions are connected to the opposite sides of the winding body, respectively, and are configured to be connected to the case.

13. The ventilation fan according to claim 10, wherein the second fastener further comprises a second tongue portion, the second tongue portion is extended from the second fastener to the first opening portion of the first fastener, a gap is defined by and located between the second tongue portion and an end portion of the first hook portion of the first fastener, the gap is smaller than a wire diameter of the at least one elastic element, and the second tongue portion is deformable.

14. The ventilation fan according to claim 10, wherein the first hook portion and the second hook portion of the fixing structure are subjected to chamfering, and the shortest distance between the first hook portion and the base and the shortest distance between the second hook portion and the base are smaller than a wire diameter of the at least one elastic element.

15. The ventilation fan according to claim 10, wherein each of the first hook portion and the second hook portion of the fixing structure comprises a turning portion and an end portion, and at least one of the turning portion and the end portion has a curved-surface structure.

* * * * *